US012667183B2

(12) United States Patent
Dilley

(10) Patent No.: US 12,667,183 B2
(45) Date of Patent: Jun. 30, 2026

(54) LOAD SUPPORT APPARATUS

(71) Applicant: Walker Dilley, Herriman, UT (US)

(72) Inventor: Walker Dilley, Herriman, UT (US)

( * ) Notice: Subject to any disclaimer, the term of this patent is extended or adjusted under 35 U.S.C. 154(b) by 14 days.

(21) Appl. No.: 18/782,750

(22) Filed: Jul. 24, 2024

(65) Prior Publication Data

US 2026/0026604 A1 Jan. 29, 2026

(51) Int. Cl.
*A45F 5/02* (2006.01)
*A47D 13/02* (2006.01)

(52) U.S. Cl.
CPC ..... *A45F 5/021* (2013.01); *A47D 13/025* (2013.01); *A47D 13/029* (2022.08)

(58) Field of Classification Search
CPC .. A45F 5/021; E05D 11/1078; E05D 11/1007
USPC ..... 224/586, 269; 16/327, 328, 329
See application file for complete search history.

(56) References Cited

U.S. PATENT DOCUMENTS 1,464,404 A * 8/1923 Blekastad ..... A47D 13/025 224/159
4,319,704 A * 3/1982 Rosen ..... A45F 5/02 224/907
5,456,394 A 10/1995 Israel
5,511,707 A * 4/1996 Reichert ..... A45F 5/00 224/678
5,826,763 A * 10/1998 Roberts ..... A45F 3/14 224/270
5,865,357 A * 2/1999 Goodwin ..... A45F 5/02 224/667
6,678,539 B1 * 1/2004 Lu ..... H04M 1/0216 16/280
6,789,710 B1 * 9/2004 Szatkowski ..... A47D 13/025 224/159
D513,875 S 1/2006 Licsko
7,110,802 B1 * 9/2006 Kim ..... H04B 1/3888 455/90.3
7,140,074 B2 * 11/2006 Han ..... H04M 1/022 16/366
7,173,825 B2 * 2/2007 Han ..... H04M 1/0216 296/192
7,418,279 B2 * 8/2008 Takagi ..... H04M 1/0216 439/31
7,631,397 B2 * 12/2009 Yin ..... G06F 1/1681 16/337
7,686,195 B2 * 3/2010 Bangert ..... A47D 13/025 224/159

(Continued)

FOREIGN PATENT DOCUMENTS

WO WO2014130904 8/2014

*Primary Examiner* — Nathan J Newhouse
*Assistant Examiner* — Lester L Vanterpool

(57) ABSTRACT

A load support apparatus for supporting a load on a user's belt includes a clip member configured to mount to the belt. The clip member comprises a front wall and a rear wall which are coupled to each other at a junction proximate a top end of the clip member. The front and rear walls define a slot therebetween sized to receive the belt. The slot has a pair of open ends, each of which is positioned on an associated one of a pair of lateral sides of the clip member. A platform is coupled to the top end of the clip member and has a support surface configured for supporting a load thereon. The platform may pivot between stored and deployed positions and lock in the deployed position.

13 Claims, 9 Drawing Sheets

(56) References Cited

U.S. PATENT DOCUMENTS

| | | | | |
|---|---|---|---|---|
| 7,841,653 | B2 * | 11/2010 | Sanchez | B60N 2/2845 24/3.12 |
| 8,783,534 | B1 * | 7/2014 | Marshall | A45F 5/021 224/269 |
| 10,349,754 | B2 * | 7/2019 | Kang | A47D 13/025 |
| 10,640,320 | B2 * | 5/2020 | Matheny | B65H 35/0026 |
| 2005/0050684 | A1 * | 3/2005 | Luo | H04M 1/0216 16/325 |
| 2005/0055805 | A1 * | 3/2005 | Hsu | H04M 1/0216 16/324 |
| 2005/0161479 | A1 * | 7/2005 | Licsko | A45F 3/14 224/270 |
| 2006/0032020 | A1 * | 2/2006 | Duan | G06F 1/1681 16/288 |
| 2007/0278270 | A1 * | 12/2007 | Castaneda | A45F 5/00 224/269 |
| 2009/0151121 | A1 * | 6/2009 | Lin | F16F 9/12 188/290 |
| 2009/0165246 | A1 * | 7/2009 | Lin | E05F 3/14 16/321 |
| 2010/0186637 | A1 * | 7/2010 | Axel | B42F 9/002 224/269 |
| 2010/0206926 | A1 * | 8/2010 | Mekis | A45F 5/02 224/269 |
| 2014/0231476 | A1 * | 8/2014 | Davis | A45F 5/021 224/271 |
| 2014/0259532 | A1 * | 9/2014 | Millard | E05D 11/1028 16/326 |

* cited by examiner

LOAD SUPPORT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to load support apparatuses and more particularly pertains to a new load support apparatus for supporting a load on a user's belt.

(2) Description of Related Art Including Information Disclosed Under 37 CFR 1.97 and 1.98

The prior art discloses myriad apparatuses which attach to a user's belt to assist in supporting the load on the user's person. However, the prior art fails to describe such an apparatus which uses a pivotable platform mounted at a top end of a clip member which locks in a deployed position to allow a load to be supported on the belt.

BRIEF SUMMARY OF THE INVENTION

An embodiment of the disclosure meets the needs presented above by generally comprising a clip member configured to mount to a belt. The clip member comprises a front wall and a rear wall which are coupled to each other at a junction proximate a top end of the clip member. The front and rear walls define a slot therebetween sized to receive the belt. The slot has a pair of open ends, each of which is positioned on an associated one of a pair of lateral sides of the clip member. A platform is coupled to the top end of the clip member and has a support surface configured for supporting a load thereon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
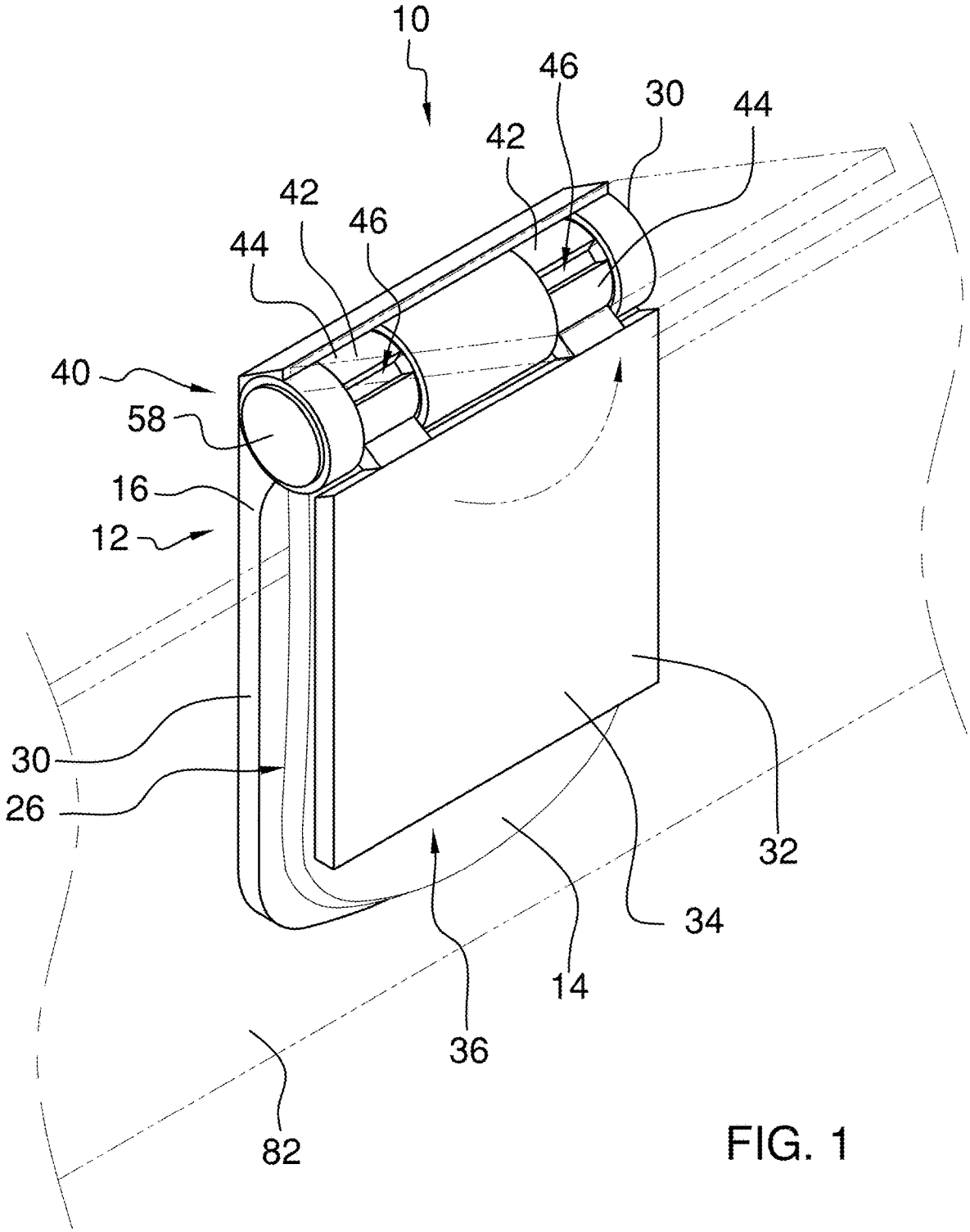
FIG. 1 is a perspective view of a load support apparatus in use on a belt according to an embodiment of the disclosure.
Figure 2:
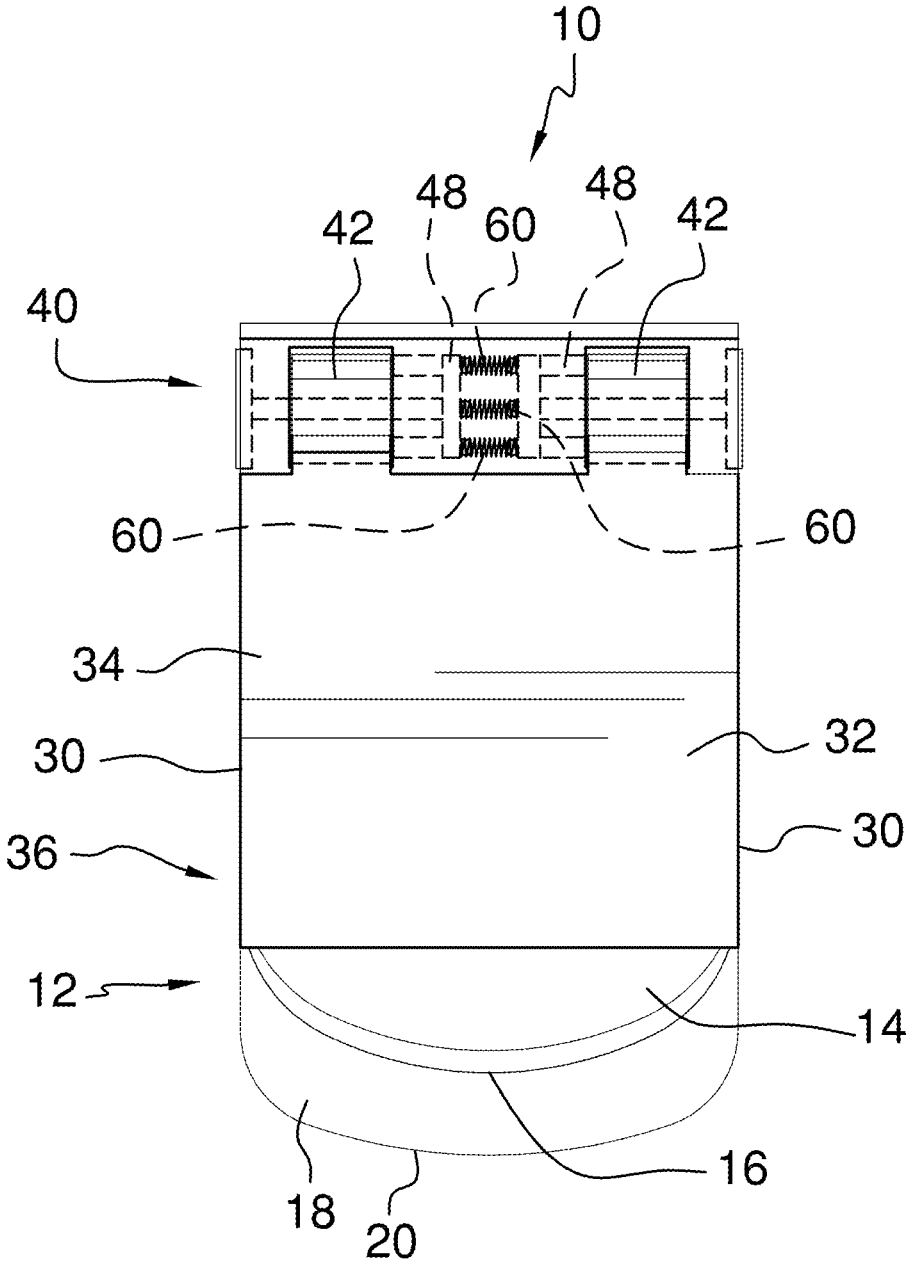
FIG. 2 is a front view of an embodiment of the disclosure.
Figure 3:
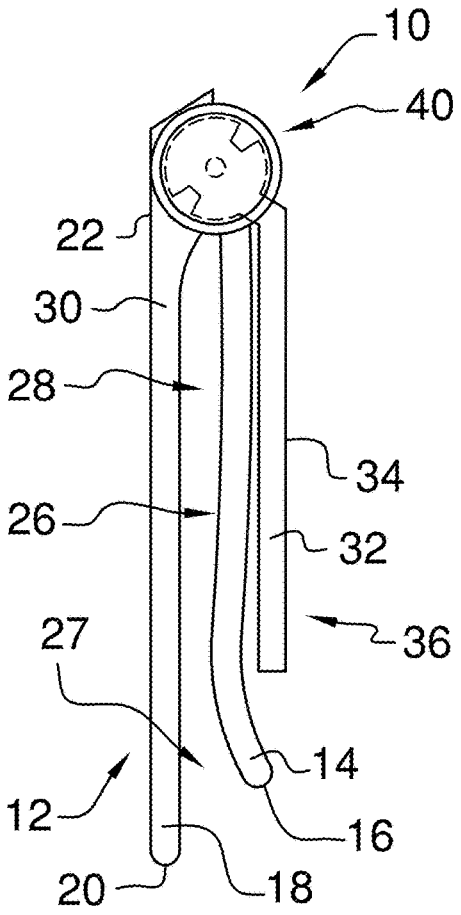
FIG. 3 is a side view of an embodiment of the disclosure showing a platform in a stored position.
Figure 4:
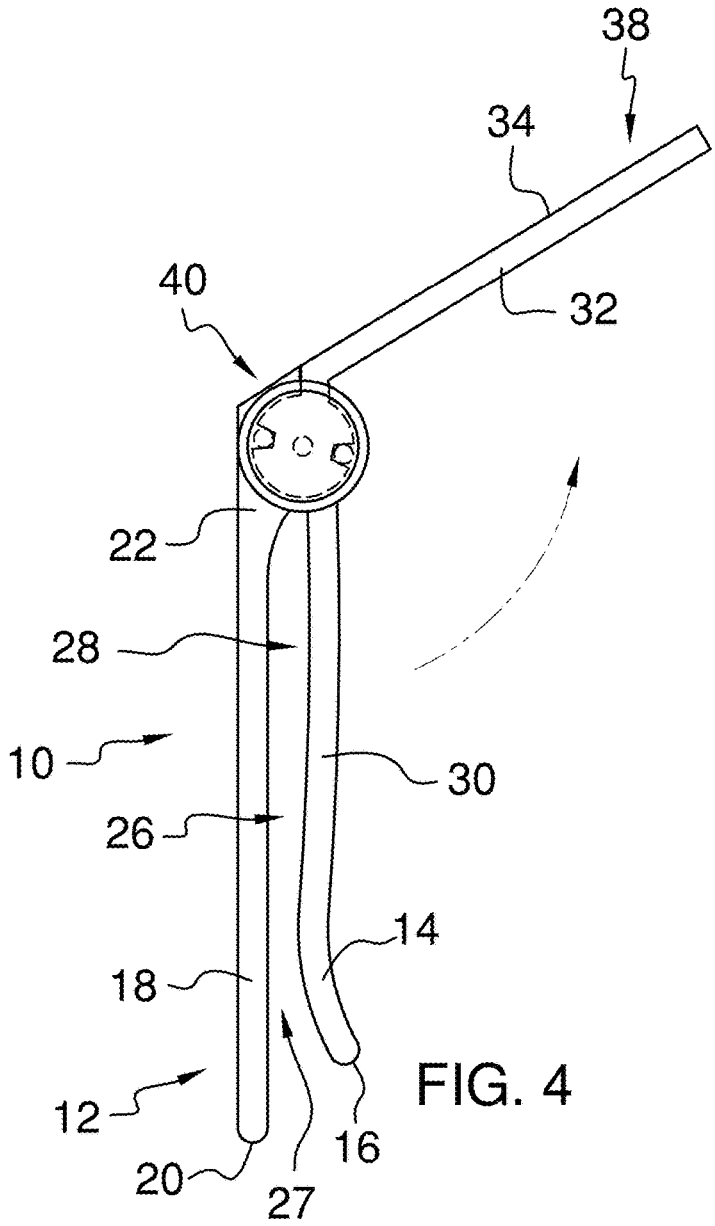
FIG. 4 is a side view of an embodiment of the disclosure showing a platform in a deployed position.
Figure 5:
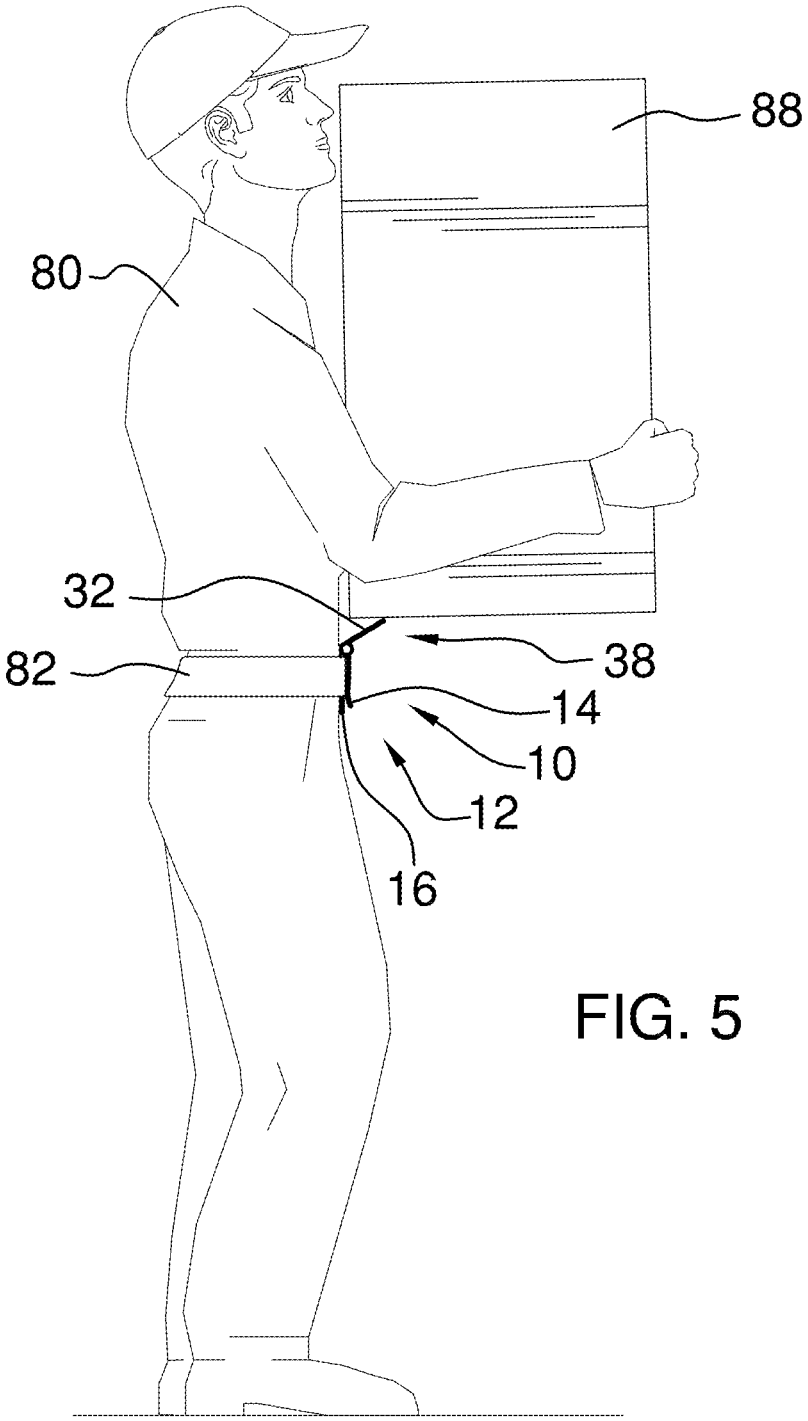
FIG. 5 is an in-use view of an embodiment of the disclosure.
Figure 6:
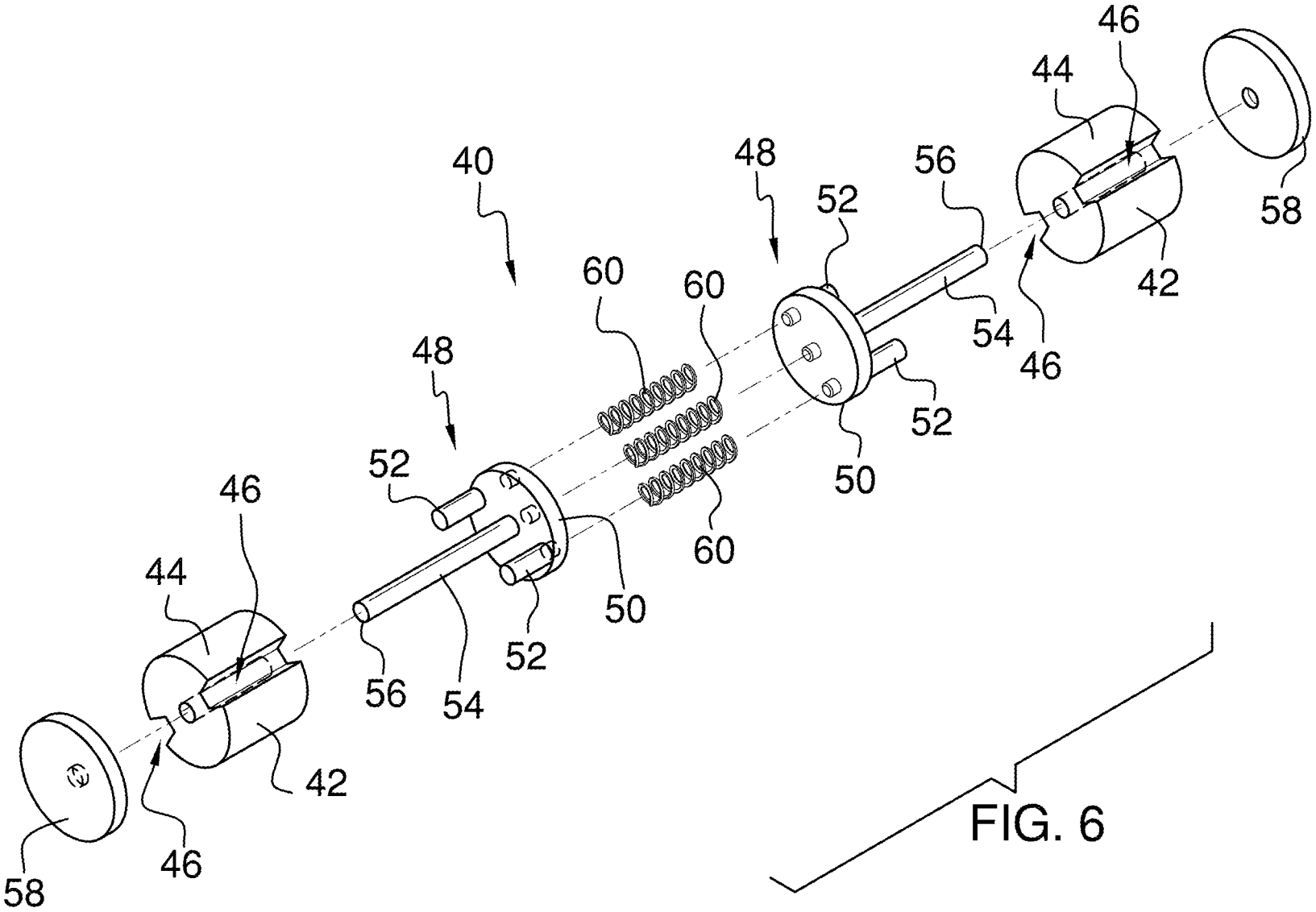
FIG. 6 is an exploded view of a locking mechanism of an embodiment of the disclosure.

With reference now to the drawings, and in particular to FIGS. 1 through 12 thereof, a new load support apparatus embodying the principles and concepts of an embodiment of the disclosure and generally designated by the reference numeral 10 will be described.

As best illustrated in FIGS. 1 through 12, the load support apparatus 10 generally comprises a clip member 12 configured to mount to a belt 82 worn by a user 80. The clip member 12 comprises a front wall 14 and a rear wall 18 which are coupled to each other at a junction 24 proximate a top end 22 of the clip member 12. The front and rear walls 14, 18 define a slot 26 therebetween sized to receive the belt 82. The slot 26 has a pair of open ends 28, each of which is positioned on an associated one of a pair of lateral sides 30 of the clip member 12. The clip member 12 may be attached to the belt 82 such that the belt 82 extends through each open end 28 of the slot 26, and the clip member 12 hangs on a top edge of the belt 82. A platform 32 is coupled to the top end 22 of the clip member 12. The platform 32 has a support surface 34 configured for supporting a load 88 thereon.

During use, the user 80 places the load 88 on the support surface 34 to support at least a portion of the weight of the load 88 on the load support apparatus 10. The portion of the weight of the load 88 exerted against the load support apparatus 10 is then transferred to the user's 80 waist or hips, which allows the user 80 to carry loads while reducing strain on the user's 80 back.

With reference to FIGS. 1 through 6, an embodiment is depicted in which the platform 32 is pivotally coupled to the clip member 12 about a pivot axis. The platform 32 is movable between a stored position 36 and a deployed position 38. When in the deployed position 38, the platform 32 extends forwardly from the clip member 12 and the support surface 34 faces upwardly with respect to the clip member 12. When in the stored position 36, the platform 32 lies against the front wall 14 of the clip member 12 and the support surface 34 faces forwardly from the clip member 12.

A locking mechanism 40 is shown which is operable to secure the platform 32 in the deployed position 38. The locking mechanism 40 comprises a pair of shafts 42 which are fixedly coupled to the platform 32 and are rotatable about the pivot axis with respect to the clip member 12. The shafts 42 are spaced apart from each other along the pivot axis. Each shaft 42 defines a pair of keyways 46 in a perimeter surface 44 of the shaft 42, each of which extends parallel to the pivot axis. A pair of engagement members 48 are positioned and biased to lockingly engage an associated one of the shafts 42. Each engagement member 48 comprises a base 50, a pair of locking pins 52, a rod 54, and a release button 58. The locking pins 52 and the rod 54 are coupled to and extend away from the base 50. The release button 58 is positioned on a distal end 56 of the rod 54 with respect to the base 50. The base 50 of each engagement member 48 is positioned inwardly of the associated engagement member 48, the rod 54 extends through the associated engagement member 48, and the release button 58 is positioned outwardly of the associated engagement member 48. The locking pins 52 align with the keyways 46 of the associated shaft 42 when the platform 32 is positioned in the deployed position 38, and each engagement member 48 is biased to insert its locking pins 52 into the keyways 46 to retain the platform 32 in the deployed position 38.

Biasing members 60 are coupled to and extend between the pair of engagement members 48, biasing the engagement members 48 away from each other and into locking engagement with the shafts 42. The biasing members 60 are compression springs, but other biasing means may be used. In some embodiments, separate biasing members 60 may be used for the separate engagement members 48. To release the platform 32 from the deployed position 38, the release buttons 58 may be pressed, such as by squeezing between the user's 80 fingers, thereby moving the engagement members 48 against bias and removing the locking pins 52 from the keyways 46.

The support surface 34 in this embodiment forms an obtuse angle with the rear wall 18 of the clip member 12 such that the support surface 34 is inclined upwardly away from the user 80 during normal use when the user 80 stands upright. However, the support surface 34 may be oriented to be perpendicular to or form an acute angle with the rear wall 18 in other embodiments.

Figure 7:
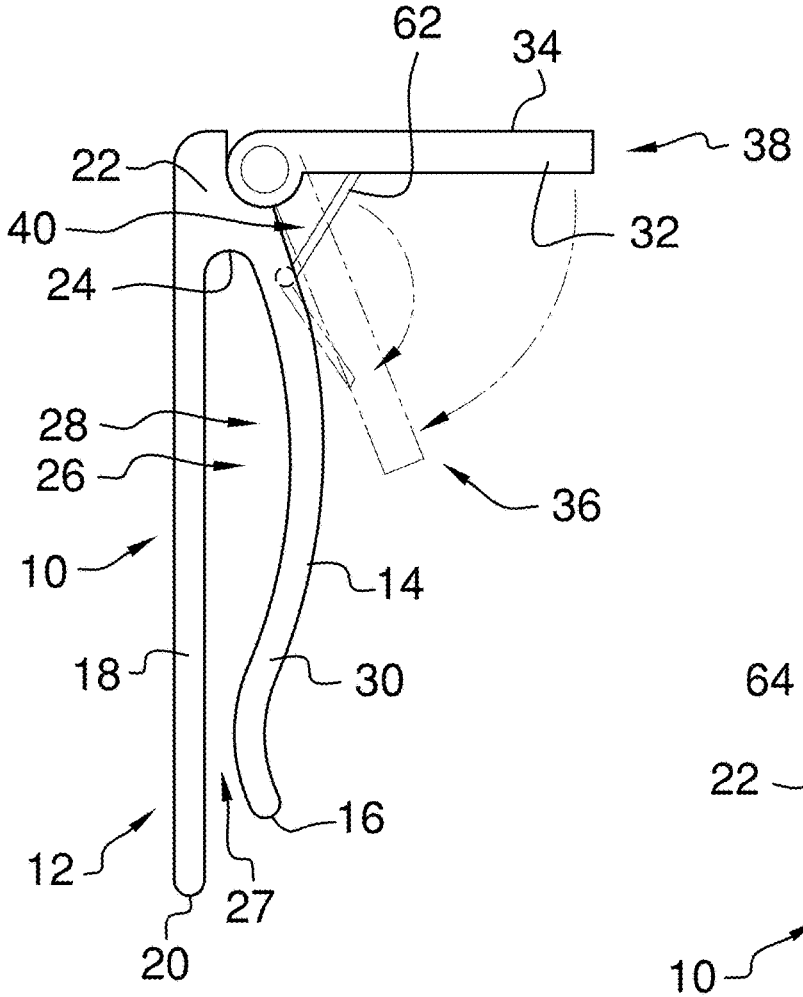
FIG. 7 is a side view of an embodiment of the disclosure.

FIG. 7 shows an embodiment of the present disclosure in which the platform 32 is pivotable as described above between the stored position 36 and the deployed position 38. The locking mechanism 40 comprises a brace 62 which is pivotally coupled to the clip member 12. The brace 62 may be positioned to support the platform 32 against the clip member 12 when the platform 32 is in the deployed position 38, thereby securing the platform 32 in the deployed position 38 provided a sufficient force keeps the platform 32 against the brace 62.

In other embodiments, various other locking mechanisms may be used. For example, detent hinges, ratchets configured to allow the platform only to raise until released, and the like may be used to secure the platform 32 in useful positions for supporting a load.

Figure 8:
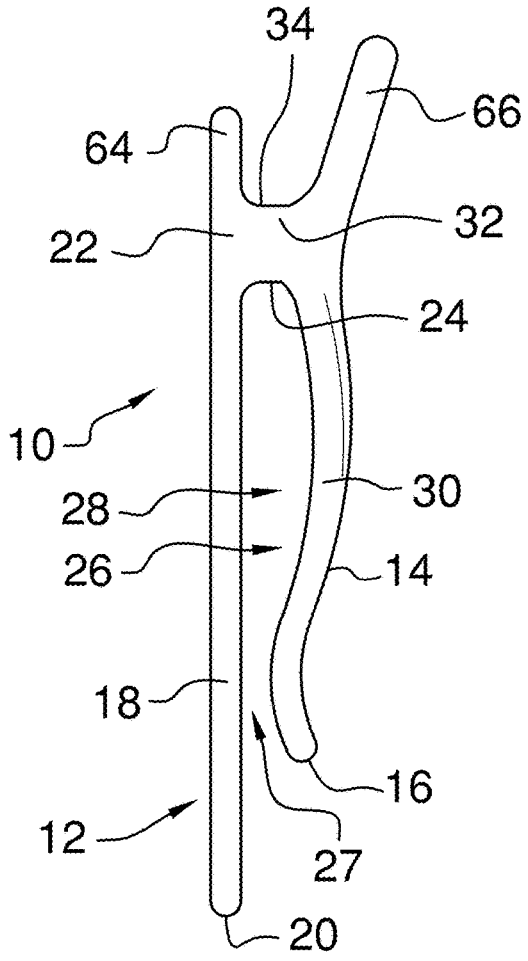
FIG. 8 is a side view of an embodiment of the disclosure.

With reference to FIG. 8, an embodiment is depicted which includes a stop member 64 and a flange 66. The stop member 64 is coupled to and extends upwardly from the clip member 12. The stop member 64 is oriented substantially coplanar to the rear wall 18 of the clip member 12. The flange 66 is coupled to and extends upwardly from the clip member 12. The flange 66 is forwardly spaced from the stop member 64 across the platform 32 and is angled to extend upwardly and forwardly from the clip member 12. A load may be positioned between the flange 66 and the stop member 64 during use. The stop member 64 prevents the load from impinging on the user 80, and the load may lean against the flange 66 to retain the load on the load support apparatus 10.

Figure 9:
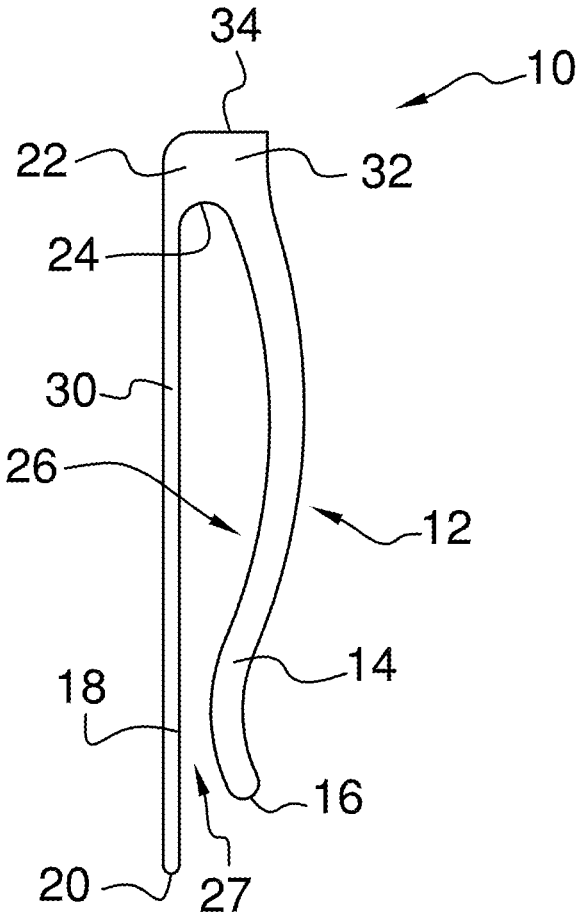
FIG. 9 is a side view of an embodiment of the disclosure.
Figure 10:
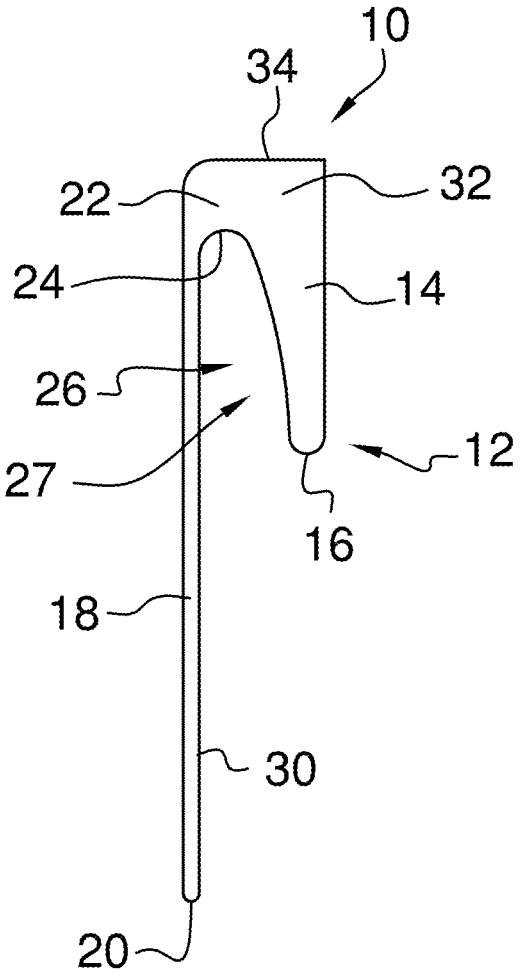
FIG. 10 is a side view of an embodiment of the disclosure.

FIGS. 9 and 10 depict embodiments in which a bottom 27 of the slot 26 is open such that the clip member 12 may receive the belt 82 into the slot 26 through the bottom 27 of the slot 26. In FIG. 9, a height of the rear wall 18 from the junction 24 to a bottom end 20 of the rear wall 18 is substantially equivalent to a height of the front wall 14 from the junction 24 to a bottom end 16 of the front wall 14. In FIG. 10, the rear wall 18 extends downwardly away from the junction 24 farther than the front wall 14.

Figure 11:
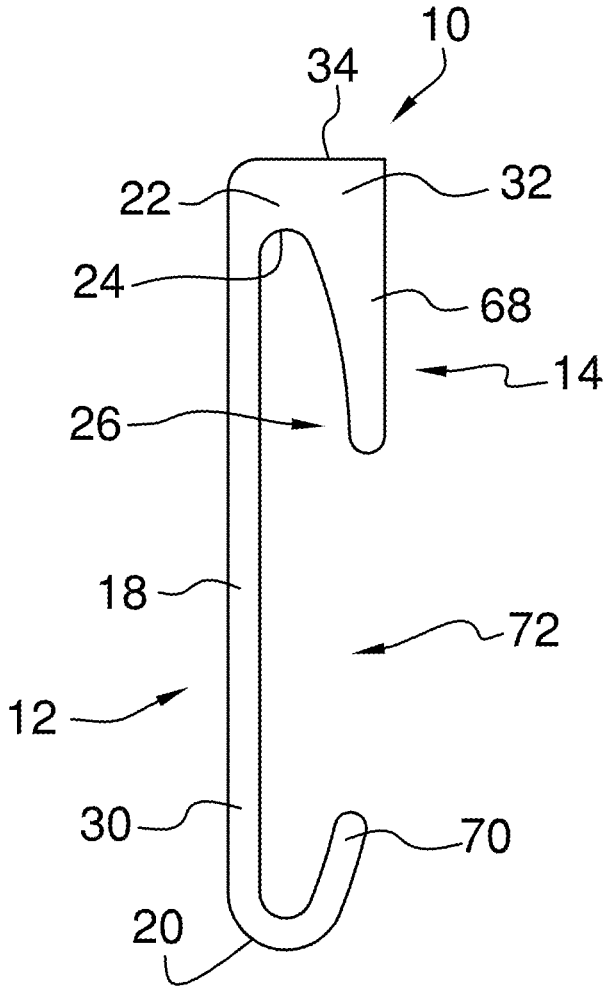
FIG. 11 is a side view of an embodiment of the disclosure.

With reference to FIG. 11, the front wall 14 comprises a pair of front segments which are spaced from each other. The front segments include a top front segment 68 and a bottom front segment 70. The top front segment 68 is coupled to the rear wall 18 at the junction 24 proximate the top end 22 of the clip member 12, and the bottom front segment 70 which is coupled to a bottom end 20 of the rear wall 18. The top front segment 68 and the bottom front segment 70 define an opening 72 to the slot 26 therebetween.

Figure 12:
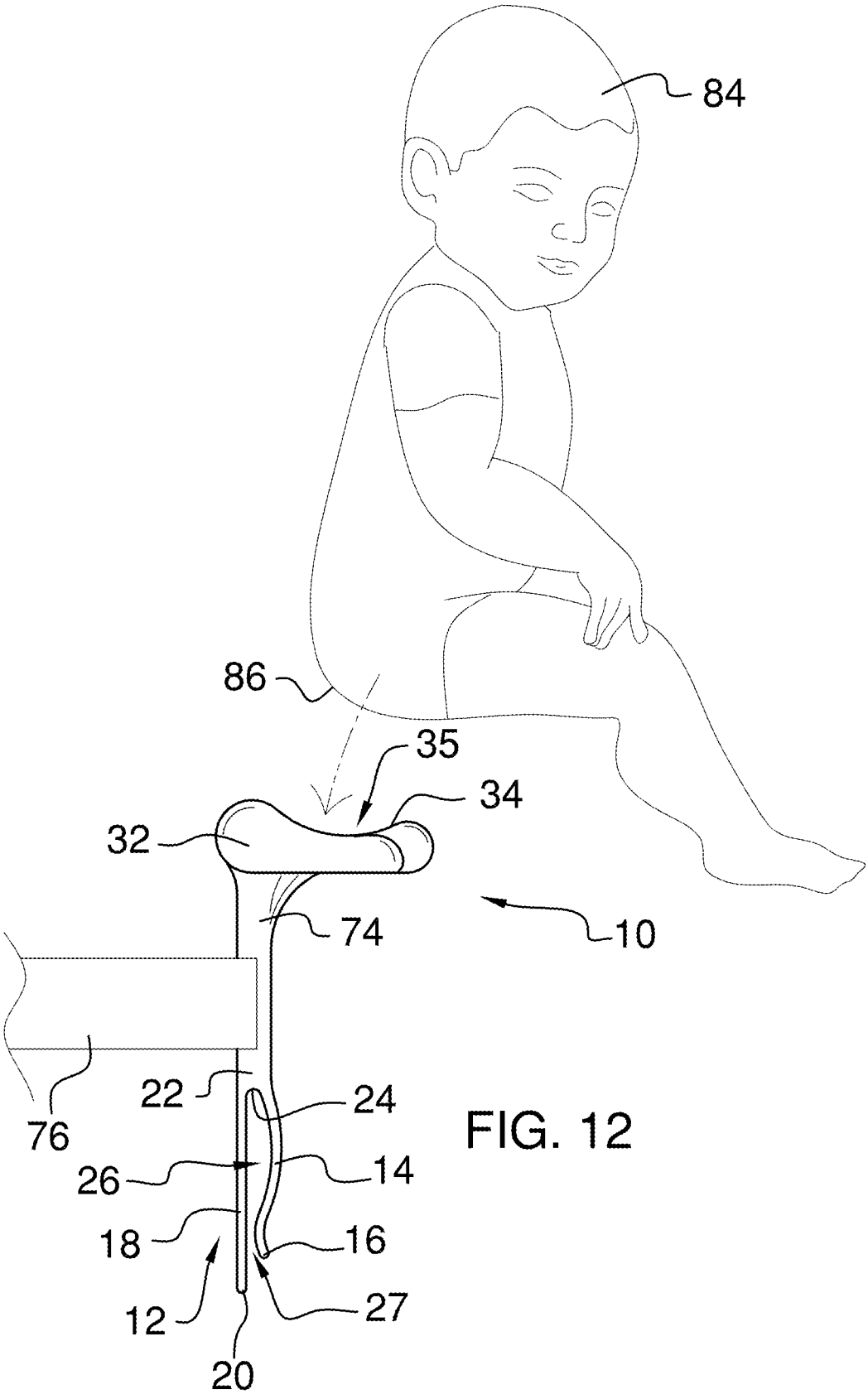
FIG. 12 is an exploded in-use view of an embodiment of the disclosure.

In FIG. 12, an embodiment is depicted in which a connecting member 74 is coupled to and extends between the platform 32 and the clip member 12. The connecting member 74 couples the platform 32 to the top end 22 of the clip member 12, and an auxiliary belt 76 coupled to the connecting member 74 which is configured to extend around an abdomen of the user 80, thereby providing additional support to secure the load support apparatus 10 to the user 80. The platform 32 extends forwardly from the connecting member 74 with respect to the clip member 12 and defines a recess 35 in the support surface 34 sized to receive buttocks 86 of an infant 84 therein. The infant 84 may therefore be set on the platform 32 to facilitate the user 80 in carrying or holding the infant 84.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A load support apparatus for use on a belt, the apparatus comprising:

a clip member configured to mount to the belt, the clip member comprising a front wall and a rear wall, the front and rear walls being coupled to each other at a junction proximate a top end of the clip member, the front and rear walls defining a slot therebetween sized to receive the belt, the slot having a pair of open ends, each open end of the pair of open ends being positioned on an associated one of a pair of lateral sides of the clip member;

a platform coupled to the top end of the clip member, the platform having a support surface configured for supporting a load thereon;

wherein the platform is pivotally coupled to the clip member about a pivot axis, the platform being movable between a stored position and a deployed position, the platform extending forwardly from the clip member when in the deployed position, the support surface of the platform facing upwardly with respect to the clip member when the platform is in the deployed position, the platform lying against the front wall of the clip member when in the stored position, the support surface of the platform facing forwardly from the clip member when the platform is in the stored position, further comprising a locking mechanism operable to secure the platform in the deployed position;

wherein the locking mechanism comprises:

a pair of shafts fixedly coupled to the platform, the pair of shafts being rotatable about the pivot axis with respect to the clip member, the shafts being spaced apart from each other along the pivot axis, each shaft of the pair of shafts defining a keyway therein which extends parallel to the pivot axis;

a pair of engagement members, each engagement member of the pair of engagement members being biased toward an associated shaft of the pair of shafts, each engagement member comprising:

a base;

a locking pin coupled to the base which aligns with the keyway of the associated shaft when the platform is in the deployed position, the engagement member being biased to insert the locking pin into the keyway of the associated shaft when aligned, thereby securing the platform in the deployed position;

a rod coupled to the base which extends through the associated shaft along the pivot axis, the associated shaft being rotatable about the rod; and a release button coupled to the rod opposite the base;

wherein the bases of the engagement members are positioned inwardly of the shafts, the release buttons of the engagement members being positioned outwardly of the shafts; and a biasing member coupled to and extending between the pair of engagement members, the biasing member biasing the engagement members away from each other and into locking engagement with the shafts.

2. The apparatus of claim 1, wherein the locking mechanism comprises:

a shaft fixedly coupled to the platform, the shaft being rotatable about the pivot axis with respect to the clip member; and an engagement member positioned and biased to lockingly engage the shaft when the platform is in the deployed position, the engagement member being configured to secure the platform in the deployed position when the engagement member lockingly engages the shaft, the engagement member being movable against bias to disengage the shaft.

3. The apparatus of claim 2, wherein:

the shaft of the locking mechanism defines a keyway which is oriented parallel to the pivot axis; and the engagement member of the locking mechanism comprises a locking pin which aligns with the keyway when the platform is in the deployed configuration, the engagement member being biased to insert the locking pin into the keyway of the shaft when aligned, thereby securing the platform in the deployed configuration.

4. The apparatus of claim 3, wherein the engagement member further comprises:

a base, the locking pin being coupled to and extending away from the base;

a rod coupled to the base, the rod extending through the shaft along the pivot axis; and a release button coupled to the rod opposite the base.

5. The apparatus of claim 1, wherein the locking mechanism comprises a brace pivotally coupled to the clip member, the brace being positionable to support the platform against the clip member when the platform is in the deployed position.

6. The apparatus of claim 1, further comprising:

a stop member coupled to and extending upwardly from the clip member; and a flange couped to and extending upwardly from the clip member, the flange being forwardly spaced from the stop member across the platform.

7. The apparatus of claim 6, wherein the stop member is coplanar with the rear wall of the clip member.

8. The apparatus of claim 6, wherein the flange is angled to extend upwardly and forwardly from the clip member.

9. The apparatus of claim 1, wherein a bottom of the slot is open such that the clip member may receive the belt into the slot through the bottom of the slot.

10. The apparatus of claim 9, wherein a height of the rear wall from the junction to a bottom end of the rear wall is equivalent to a height of the front wall from the junction to a bottom end of the front wall.

11. The apparatus of claim 9, wherein the rear wall extends downwardly away from the junction farther than the front wall.

12. The apparatus of claim 1, wherein the front wall comprises a pair of front segments which are spaced from each other, the pair of front segments including a top front segment which is coupled to the rear wall at the junction proximate the top end of the clip member, the pair of front segments including a bottom front segment which is coupled to a bottom end of the rear wall, the top front segment and the bottom front segment defining an opening to the slot therebetween.

13. The apparatus of claim 1, further comprising:

a connecting member being coupled to and extending between the platform and the clip member, the connecting member coupling the platform to the top end of the clip member; and an auxiliary belt coupled to the connecting member and being configured to extend around an abdomen of a user wearing the belt;

wherein the platform extends forwardly from the connecting member with respect to the clip member, the platform defining a recess in the support surface sized to receive buttocks of an infant therein.

* * * * *